United States Patent [19]

Sirand

[11] Patent Number: 4,515,554

[45] Date of Patent: May 7, 1985

[54] IGNITION AND FUEL SUPPLY SYSTEM FOR A GAS-FUELED HEAT-RADIATOR

[75] Inventor: Joseph Sirand, Laplume, France

[73] Assignee: S.A.R.L Centre d'Etude et de Realisation d'Equipment et de Materiel C.E.R.E.M., Laplume, France

[21] Appl. No.: 454,004

[22] Filed: Jan. 5, 1983

[51] Int. Cl.[3] ..... F23N 5/00

[52] U.S. Cl. ..... 431/78; 431/45; 431/61; 431/328; 431/89

[58] Field of Search ..... 431/6, 36, 61, 78, 89, 431/80, 326, 328, 45, 46, 53, 55, 77; 137/599, 66; 251/68, 69

[56] References Cited

U.S. PATENT DOCUMENTS

| | | | |
|---|---|---|---|
| 306,652 | 10/1884 | Smith | 431/89 |
| 2,682,016 | 6/1954 | Matthews | 431/80 |
| 2,962,092 | 11/1960 | Thornbery | 431/45 |
| 3,265,112 | 8/1966 | Eckelberry et al. | 431/45 |
| 3,905,394 | 9/1975 | Jerde | 431/89 |
| 4,025,281 | 5/1977 | Lapp | 431/192 |
| 4,029,451 | 6/1977 | Farnia | 431/328 |
| 4,140,471 | 2/1979 | Straitz et al. | 431/61 |
| 4,272,237 | 6/1981 | Smith | 431/328 |

*Primary Examiner*—Larry Jones
*Assistant Examiner*—Noah Kamen
*Attorney, Agent, or Firm*—Harold H. Dutton, Jr.

[57] ABSTRACT

An ignition and fuel supply system for gas-fueled heat radiators of the type comprising an upstream fuel feed (6), a safety valve (20) in the vicinity of the radiator, a pilot device (27) mounted on the radiator to allow reignition and a feed conduit (4) for the gas; the system includes a bypass (15) equipped with gas-expanding devices (14) providing a pressure less than the pressures in the heating areas, whereby the pilot flame device (27) may be fed from the same conduit (4) used for the heating areas; a selection valve (24) is arranged in the radiator injection conduit in order to be closed at the pressure of the pilot flame; an ignition branch line (16) is arranged as a shunt of the upstream feed means (6) in order to supply gas at a pressure exceeding the pressures of the heating modes at the time an electrical igniter (19) is actuated to assure electrical ignition of the radiator.

13 Claims, 2 Drawing Figures

Figure 1:
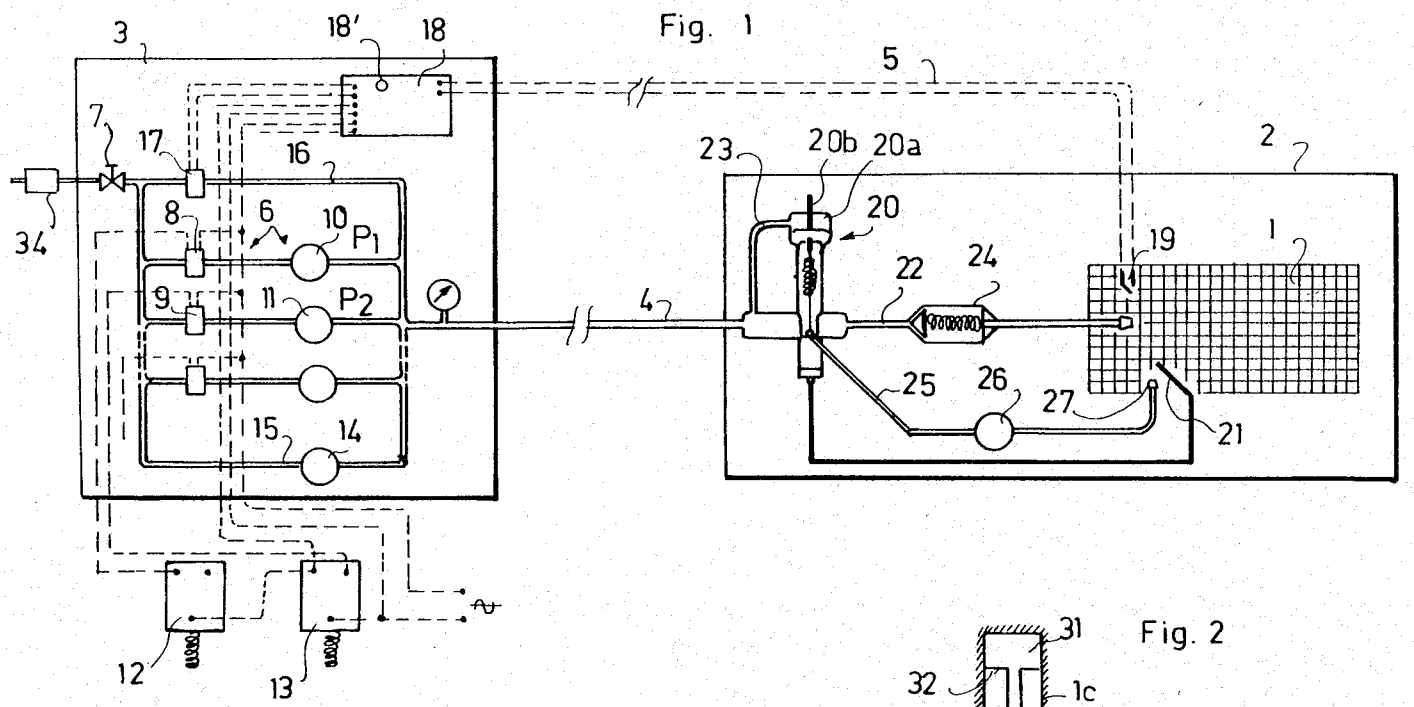

1
2
3
4
5
6
7
8
9
10
11
12
13
14
15
16
17
18
18'
19
20
20a
20b
21
22
23
24
25
26
27
34
P1
P2

1
1a
1b
1c
1d
1e
24
25
26
28
29
30
31
32
33

IGNITION AND FUEL SUPPLY SYSTEM FOR A GAS-FUELED HEAT-RADIATOR

This invention relates to an ignition and fuel supply system for gas fueled radiator-heaters. In particular, the invention applies to infrared radiators and may be used in agriculture to heat buildings for animal raising.

The known ignition and supply systems for gas radiators as a rule include a central control and feed panel connected by gas conduits and electric cables to the various members outfitting each radiator including a burner injector, pilot-flame device, safety valve, an electromagnetic operating device for the safety valve, and possibly also an ignition spark generator or electric resistor.

Such systems suffer from the drawback of perforce requiring two independent gas conduits between the central panel and each radiator (which sometimes may be several tens to several hundred meters apart). Specifically, one conduit is needed for the main supply to the radiator burner, the other for the ancillary supply of its pilot flame, the very function of which requires that it remain lit while the radiator is shut off once the central panel has commanded supply interruption.

Moreover, known systems also suffer from the drawback of requiring for each radiator an electromechanical apparatus acting on the safety valve to keep it open during ignition so as to permit gas intake to the burner at the time of ignition. The presence of such an apparatus which requires electrical power further increases the complexity of the installation.

An object of the present invention is therefore to overcome the defficiencies of the known systems by providing a system of which the connections between the central station and the radiators are substantially simplified.

A primary object of the invention in particular consists in assuring the ignition of each radiator in the same conditions of safety as for the known systems, and in performing this with only a single gas conduit between the central station and the particular radiator.

Another object of the invention is to reduce the electrical connections between the central station and the radiator to a single cable with two conductors in the case of a system provided with a spark generator or an ignition resistor, or even to entirely eliminate these connections for a system lacking such ignition devices (the first ignition taking place manually and the subsequent ones by means of the pilot flame.)

Yet another object of the invention is to permit modulating the heating state for each radiator as a function of the temperature modalities.

A further object of the invention is to assure instantaneous re-ignition of the radiator following electric power failure when the radiator is in the automatic stop cycle, or keep it in the ignited condition if already in that state at the time of the failure.

Another object is to provide an improved pilot flame device particularly well suited to the infrared type radiators.

The supply and ignition system which is the object of the invention is of the type comprising upstream feed means adapted to be connected to a gas supply to feed the gas within the pressure range Pi corresponding to the heating modes, a safety valve located near the radiator and of which the discharge is connected to the radiator by a gas-injection conduit, the safety valve being provided with a member keeping its flap in the open position and controlled by a temperature detector; pilot flame means mounted on the radiator to allow re-ignition, and which is associated with the temperature detector or sensor to maintain the safety valve in the open position when the pilot flame is lit; and gas conveying means between the upstream feed means and the intake of the safety valve.

According to the present invention, the system is characterized by comprising in combination with the above defined means, the following:

upstream gas-expanding device connected in bypass of the upstream feed means and designed to supply the gas to the intake of the gas conveying means at a pressure pv which is less than the pressures Pi of the heating modes;

a selection valve located in the injection conduit between the safety valve and the radiator and designed to be opened at pressure equal to or higher than the pressures Pi and closed when at pressure pv;

a conduit, called the pilot-flame conduit, arranged in parallel with the injection conduit at the discharge of the safety valve in order to connect the latter to the pilot flame, this pilot flame conduit including downstream gas-expanding devices for keeping the pressure at the pilot flame at a substantially constant value.

As will be better understood in light of the discussion further below, the system of the invention allows providing as gas conveying means a single conduit connecting the upstream feed means (in particular at the central control panel) to the intake of the safety valve (solidly joined to the radiator).

When the radiator is in its automatic shut-off period (the upstream feed means then are closed), the pilot flame is fed through the above cited bypass including the upstream expansion means; the gas conveyed by the above cited single conduit is at a pressure pv insufficient to open the selection valve located upstream of the radiator burner and is moved toward the pilot flame through the pilot flame conduit.

When the burner is in its operating mode, the downstream gas-expanding devices reduce the pressure at the pilot flame to a suitable value.

In another feature of the invention, the upstream feed means comprises at least two parallel branches each provided with a controlled valve and with a gas expansion device, the expansion devices of the different branches being at different output pressures within the above cited Pi range, while the controlled valves are operating as a function of thermostatic members in order to assure heating modes which are a function of the detected temperature.

In this manner such a system assures a heating mode which can be tailored to the contemplated application. It should be noted that by the expression "controlled valve", both electric valves actuated by thermostats and any other equivalent device will be understood, in particular thermostat-controlled taps for expanding fluids and controlled by capsules of fluid connected to said taps by capillary channels.

With regard to the electrically actuated valves, one of them is of the normally open type when un-energized so as to permit feeding the gas in the heating mode in case of power failure.

Moreover the invention also applies equally well to systems lacking any automatic electric ignition devices as to such systems which include them (spark generator, electrical resistor, etc.).

In the latter case, the system of the invention evinces the following features:

a so-called ignition branch line which is arranged as a bypass of the upstream feed means and designed to supply the gas to the intake of the conveying means at a pressure Pa which exceeds the pressure Pi when the electric ignition device is actuated, the safety valve which includes means for opening its flap and is set to cause opening of the flap above a pressure level S such that $Pi<S<Pa$.

Thus during the time intervals when the electrical ignition device is being actuated (in conventional manner by a time-delay electrical igniter located on the central control panel), the ignition branch line supplies to the intake of the safety valve a gas at increased pressure $Pa<S$, whereby this valve opens. The radiator burner then will be supplied with gas and can ignite due to the action of the electrical ignition device (spark generator, resistor, etc.). At the end of this ignition sequence, the flap of the valve is kept open by its positioning member (due to the temperature sensor, which can be, for example, a thermocouple or other means located in the pilot flame itself); the heating modes corresponding to pressures Pi less than the opening threshold S of the valve may thusly be set while providing safety in case of extinction of the pilot flame.

Moreover, with regard to the infrared radiators, the pilot flame device associated with each radiator advantageously may be in the form of an infrared mini-emitter integrated into the radiator.

Figure 2:
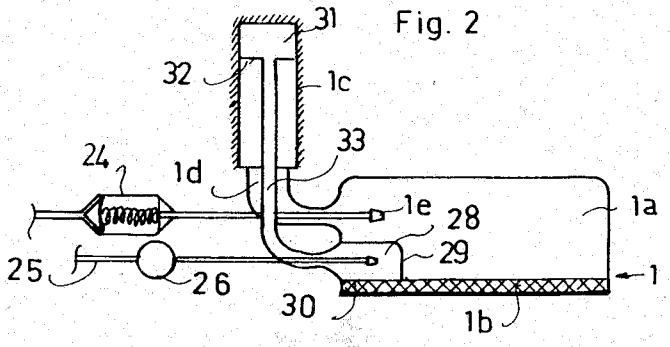

The invention outlined above in its general form will be better understood in relation to the following description and the drawing showing in illustrative and non-restrictive manner one embodiment and one variation, and in which:

FIG. 1 is a schematic of a control and supply system in accordance with the first embodiment; and FIG. 2 is a schematic and partial view of a variation of that system.

The illustrative system shown in FIG. 1 is intended to assure the required automatic safety conditions and includes igniting a radiator 1 following a period of shut-off, automatically re-igniting the radiator 1 after an automatic period of shut-off, modulating the supply to the radiator to provide heating modes adapted to the requirements, and, in the event of power failure, providing instantaneous re-ignition of the radiator if it was in an automatic shut-off period or maintaining the radiator in the ignited state if already in that condition at the time of the failure.

The gas radiator 1 may be of any known type.

The system of the invention essentially comprises two units, a unit 2 at the radiator and including means controlled by the radiator, and a unit of devices consolidated at a central control panel 3. These two units in some animal raising buildings may be separated by hundreds of meters and are joined by a single conduit 4 conveying the gas and by a two-conductor electric cable 5.

The central control panel 3 includes upstream feed means 6 connected to the gas intake tap 7 to supply the gas for the heating mode at diverse pressures Pi (P1, P2, . . . ) and to the intake of the conduit 14 (in the example, the intake pressure at the tap 7 is assumed to be at a value Pa exceeding the maximum value of the pressures Pi, a booster expander 34 if desired being provided for that purpose).

The upstream feed means 6 includes several parallel branch lines (two, three or more) each comprising an electric valve such as 8 or 9 and a gas expanding device such as 10 or 11, reducing the pressure at the intake to the pressure Pi of the branch line under consideration. The gas expanding devices 10, 11 are designed so the pressures Pi shall be of different levels to allow different heating modes.

The electric valves 8, 9 are controlled by thermostats such as 12 or 13 setting the closings or openings in accordance with sensed temperature.

One of the electric valves, for instance valve 8, will be open in the normal (unpowered) position, while the others are electric valves closed in the normal position.

The above described upstream feed means 6 are shunted by so-called upstream gas expanding devices consisting of an expander 14 mounted in a shunt 15. This expander 14 is designed to provide a pressure pv which is less than the minimum value of the pressures Pi of the heating modes.

Lastly, a so-called ignition branch line 16 is arranged in parallel with the above described means to supply the gas to the intake of the conduit 4 at a pressure Pa exceeding the maximum value of the pressures Pi of the heating modes.

In this example, the pressure Pa is assumed to be the incoming gas pressure and the ignition branch line 16 comprises an electric valve 17 closed in the normal position and electrically connected to a time-delayed electrical ignition means 18 of a type known in the art.

This time-delayed igniter 18 serves the purpose of electrically feeding by means of the conductors 5 a spark generator 19 (or any similar means) located at the radiator 1. This electrical supply—which is provided during a given time interval—is initiated either manually by means of a knob 18' or automatically by a thermostat or by any other external device.

The igniter 18 simultaneously controls the opening of the electric valve 17 in synchronization with the supply to the spark generator 19, this electric valve being closed any other time.

The unit 2 associated with each gas radiator 1 comprises a safety valve 20 of a known type including an electrical member for keeping its flap in the open position and associated with a thermocouple 21, and a pneumatic capsule **20*a*** (or a pneumatic jack) controlling the opening of its flap above a pressure threshhold S.

The intake of the safety valve 20 is connected to the conduit 4 and its discharge is connected to a conduit 22 for injecting the gas into the burner of the radiator 1. The pneumatic capsule or jack **20*a* is connected by a bypass 23 to the intake of valve 20 so that it will be the gas incoming at this valve 20 which will act on the capsule 20*a***.

The capsule **20*a*** is regulated in such a manner that its trigger threshhold S exceeds the maximum value of the pressures Pi and is less than the pressure Pa, namely $Pi<S<Pa$.

Moreover the valve 20 is provided with a manual knob **20*b*** allowing manual opening of its flap.

Again, the injection conduit 22 comprises a selection valve 24 which can be actuated by the gas passing through it, and this valve is calibrated in such a manner that it will open beyond a pressure threshhold s exceeding the pressure pv (from the shunt 15) and less than the minimum value of the pressures Pi of the heating modes, namely $pv<s<Pi$.

Also, a so-called pilot flame conduit 25 is connected in parallel with the conduit 22 at the discharge of the safety valve 20. This conduit 25 includes a downstream gas expander 26 reducing the gas pressure at a pilot flame 27 to a suitable constant value (at most equal to the pressure pv within the flow losses).

In the example of FIG. 1, the pilot flame is conventional and associated with the thermocouple 21 of the safety valve 20.

The various members of the system of the invention and their designs and arrangements having been described above, presently the operation of this system will be described.

The system is assumed to be in the completely shut-off condition, whereupon an ignition command (manual, thermostatic or other) is transmitted to the igniter 18, whereby the spark generator 19 becomes operational for a given time period and the electric valve 17 is opened for the same time period.

The gas is then supplied at pressure Pa through by-pass 16, and causes the opening of the safety valve 20 (Pa>S) and is conveyed on one hand through the injection conduit 22 toward the burner of the radiator (Pa>s) and on the other hand through the pilot flame conduit 25 to the pilot flame 27 at the appropriate pressure.

The burner and the pilot flame then are ignited by the spark generator action.

After the above mentioned time interval has passed, the safety valve 20 is kept open by the thermocouple 21 as long as the pilot flame remains lit; this pilot flame is fed through the shunt 15.

The appropriate heating mode is obtained by opening one of the electric valves 8, 9 . . . which assures the supply of gas at the suited pressure Pi. The burner is supplied with gas from the safety valve 20 (kept open) and the selection valve (Pi>s).

Automatic shut-off of the burner can take place if the temperature constraints generate the closure of all the electric valves (8, 9 . . . ). The pilot flame remains lit, the gas feeding it being conveyed to it on account of the closure of the selection valve 24 (pv<s).

Re-ignition will take place by means of the pilot flame if a heating mode Pi is again determined by opening one of the valves 8, 9 . . .

In case of electric power failure, the electric valve 8, which is normally open, opens and the burner is supplied during the power failure regardless of its mode at the beginning of the failure.

Should the pilot flame 27 accidentally extinguish, the safety valve 20 will at once close on account of the thermocouple 21, and the gas supply ceases. A new action by the igniter will be required to achieve re-ignition as described above.

The significance of the system of the invention is clear, in that it provides all the required safety features and makes it possible by means of but a single gas conduit 4 between the central station 3 and the radiator 1 to ignite, re-ignite and feed the radiator in accordance with the modulated heating modes.

FIG. 2 is a partial view showing a system similar to the previous one, but provided with an improved pilot device, and to facilitate understanding, the same reference numerals are used in FIG. 2 as in FIG. 1 to denote the same elements.

The radiator 1 is an infrared radiator consisting of a combustion chamber 1*a*, a radiator plate 1*b*, an air intake 1*c* connected by a conduit 1*d* to the chamber 1*a* and a gas injector 1*e*. The pilot device in this embodiment is an infrared mini-emitter integrated into the radiator.

This pilot device essentially consists of:

a small combustion chamber 28 within the chamber 1*a* of the radiator and insulated from chamber 1*a* by a partition 29, with the pilot flame conduit 25 issuing into the small chamber 28;

a small radiating disk 30 comprising a part of the radiating plate 1*b* of the radiator 1;

a filtration zone 31 part of the filter 1*c* and insulated by a partition 32, where this zone is connected by a conduit 33 to the small combustion chamber 28.

Such a pilot flame device functions as an infrared radiator and allows further simplifying the system while simultaneously improving its operation (reducing the chances of accidental shut-off of the pilot flame). If desired or appropriate, it can be designed to be a low-intensity light source, acting then as a pilot light.

While this invention has been described as having a preferred design, it will be understood that it is capable of further modification. This application is therefor intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What I claim is:

1. A supply and ignition system for gas-fueled heater-radiators comprising upstream feed means for connection to a source of gas and for supplying the gas within a pressure range Pi corresponding to the heating mode requirements of said heat radiator, said upstream feed means comprising at least two parallel branch lines each provided with a controlled valve and with a gas-expanding device, the expanding devices of different branch lines being at different discharge pressures within said range Pi, and said controlled valves being controlled by thermostatic means for assuring heating modes as a function of sensed temperature, said controlled valves comprising electric valves, and one of said electric valves being normally open in the absence of energization so as to enable the supply of gas in the event of power failure, a gas burning heat-radiator remote from said feed means, a safety valve in proximity to said heat-radiator and having a gas discharge conduit connected to said heat radiator by a gas injection conduit, temperature sensing means for controlling the opening of said safety valve, pilot means mounted on said heat radiator for ignition thereof and operatively connected to said temperature sensing means whereby said safety valve is maintained in the open position when said pilot means is lit, a pilot flame conduit in parallel with said gas injection conduit for connecting said safety valve with said pilot means, means for conveying gas from said feed means to said safety valve, upstream gas expanding means connected in parallel with said feed means for continuously supplying gas to said conveying means at a pressure pv less than the presures Pi of the heating modes, a gas pressure responsive selector valve in said gas injection conduit adapted to open at pressures equal to or greater than Pi and thereby permit gas flow to said heater-radiator and to close at the pressure pv and thereby only permit gas flow to said pilot flame conduit, said pilot flame conduit including gas expanding means for reducing the gas pressure at said pilot means to a substantially constant value.

2. A supply and ignition system as in claim 1 and wherein said gas conveying means comprises a single conduit connecting the upstream feed means to the intake of said safety valve.

3. A supply and ignition system as in claim 2 for igniting and supplying infrared radiators comprising a combustion chamber, a radiator plate and an intake air-filter before said combustion chamber, said system being characterized in that said pilot means associated with each radiator comprises an infrared mini-emitter integrated into said radiator.

4. A supply and ignition system as in claim 3 and wherein said infrared mini-emitter comprises a small combustion chamber within the combustion chamber of said radiator and insulated therefrom by a partition, said pilot-flame conduit issuing into said chamber, a small radiating disk comprising a portion of said radiator plate of said infrared radiator.

5. A supply and ignition system as in claim 4 and wherein said infrared mini-emitter includes an air feed for said small combustion chamber, said air feed comprising a filtration zone of said air intake filter insulated by a partition.

6. A supply and ignition system as in claim 1, wherein said selection valve in said injection conduit is controlled by the gas passing therethrough when beyond a pressure threshhold s such that $pv<s<Pi$.

7. A supply and ignition system as in claim 6 and wherein said safety valve includes a thermocouple as said temperature sensor.

8. A supply and ignition system as in claim 7 and including a time-delay electric igniter for actuating an electric ignition device mounted on said radiator, and further including an ignition branch-line in parallel with said upstream feed means and adapted to supply the gas to the intake of the gas conveying means at a pressure Pa exceeding the pressures Pi when the electric igniter is actuated, said safety valve being of the type comprising means for opening its flap and adjusted to initiate said opening above a pressure threshhold S such that $Pi<S<Pa$.

9. A supply and ignition system as in claim 7, characterized in that said ignition branch line (16) comprises a normally closed electric valve (17) electrically connected to the time-delay electric igniter (18) in order to actuate its opening in synchronization with the actuation of the electric igniter (19) on the radiator.

10. A supply and ignition system as in claim 8 and wherein said safety valve is of the type opening by means of a pneumatic capsule characterized in that said system includes a bypass connecting said pneumatic capsule or jack to the intake of the safety valve.

11. A supply and ignition system as in claim 8 and wherein said upstream feed means, said upstream gas expanding means and said ignition branch line are consolidated on a central control panel, and said safety valve, said selector valve, said pilot means, a downstream gas expanding means on said pilot flame conduit and said igniter form a unit mounted on said radiator, said unit being connected to said central control panel by a single gas conduit.

12. A supply and ignition system as in claim 10, wherein said safety valve includes a manual knob for manually opening its flap.

13. A supply and ignition system for gas-fueled infrared radiators comprising upstream feed means for connection to a source of gas and for supplying the gas within a pressure range Pi corresponding to the heating mode requirements of said heat radiator, said upstream feed means comprising at least two parallel branch lines each provided with a controlled valve and with a gas-expanding device, the expanding devices of different branch lines being at different discharge pressures within said range Pi, and said controlled valves being controlled by thermostatic means for assuring heating modes as a function of sensed temperature, said controlled valves comprising electric valves, and one of said electric valves being normally open in the absence of energization so as to enable the supply of gas in the event of power failure, a gas burning infrared radiator remote from said feed means, a safety valve in proximity to said infrared radiator and having a gas discharge conduit connected to said infrared radiator by a gas injection conduit, temperature sensing means for controlling the opening of said safety valve, pilot means mounted on said infrared radiator for ignition thereof and operatively connected to said temperature sensing means whereby said safety valve is maintained in the open position when said pilot means is lit, said pilot means being integrated with said infrared radiator and comprising a combustion chamber, a radiator plate and an intake air-filter before said combustion chamber, a pilot flame conduit in parallel with said gas injection conduit for conveying gas from said safety valve to said combustion chamber, means for conveying gas from said feed means to said safety valve, upstream gas expanding means connected in parallel with said feed means for continuously supplying gas to said conveying means at a pressure pv less than the pressures Pi of the heating modes, a gas pressure responsive selector valve in said gas injection conduit adapted to open at pressures equal to or greater than Pi and thereby permit gas flow to said infrared radiator and to close at the pressure pv and thereby only permit gas flow to said pilot flame conduit, said pilot flame conduit including gas expanding means for reducing the gas pressure at said pilot means to a substantially constant value.

* * * * *